US005360361A

United States Patent [19]

Bechtel et al.

[11] Patent Number: 5,360,361

[45] Date of Patent: Nov. 1, 1994

[54] METHOD OF MANUFACTURING A DISPLAY TUBE

[75] Inventors: Helmut Bechtel, Roetgen; Wolfram Czarnojan; Stefan Gruhlke, both of Aachen; Ulrich Kynast, Roetgen, all of Germany

[73] Assignee: U.S. Philips Corporation, New York, N.Y.

[21] Appl. No.: 93,280

[22] Filed: Jul. 16, 1993

[30] Foreign Application Priority Data

Jul. 16, 1992 [DE] Germany ..... 4223351

[51] Int. Cl.[5] ..... H01J 9/38

[52] U.S. Cl. ..... 445/40; 445/41; 445/56

[58] Field of Search ..... 445/16, 24, 40, 41, 445/42, 56, 57

[56] References Cited

U.S. PATENT DOCUMENTS 2,871,086 1/1959 Korner et al. ..... 445/40
5,160,287 11/1992 Hirasawa ..... 445/40

FOREIGN PATENT DOCUMENTS 58-126638 7/1983 Japan ..... 445/56
58-126639 7/1983 Japan ..... 445/56

OTHER PUBLICATIONS

"Advanced technology: flat cold-cathode CRTs" by Ivor Brodie; Information Display Jan. 1989; pp. 17–19.
"Phosphor screens in cathode-ray tubes for projection television" by R. Raue, A. T. Vink and T. Welker; Philips Tech. Rev. 44, No. 11/12, 335–347, Nov. 1989.
"Field-emitter arrays applied to vacuum fluorescent display" by C. A. spindt, C. E. Holland, I. Brodie, J. B. Mooney and E. R. Westerberg, *IEEE Trans. on Electron Devices,* vol. 36, No. 1, Jan. 1989, pp. 225–228.
V. L. Grimm et al., "Physikalisch-Chemische und Chemische Vorgänge . . . ", *Valve Berichte,* 1974, pp. 77–92.

*Primary Examiner*—P. Austin Bradley
*Assistant Examiner*—Jeffrey T. Knapp
*Attorney, Agent, or Firm*—John C. Fox; Norman N. Spain

[57] ABSTRACT

The luminescent phosphor degradation in a cathode ray display tube, caused by aging, is decreased. This decrease is achieved by introducing before and/or during evacuation a hydrolyzable gas into the tube's inner space for a limited time interval, using a partial pressure which is essentially larger than the eventual final vacuum pressure of the cathode ray tube, and then allowing the final vacuum pressure to be achieved without any further supply of gas. Thereafter, the cathode ray tube is sealed in a gastight manner.

14 Claims, 1 Drawing Sheet

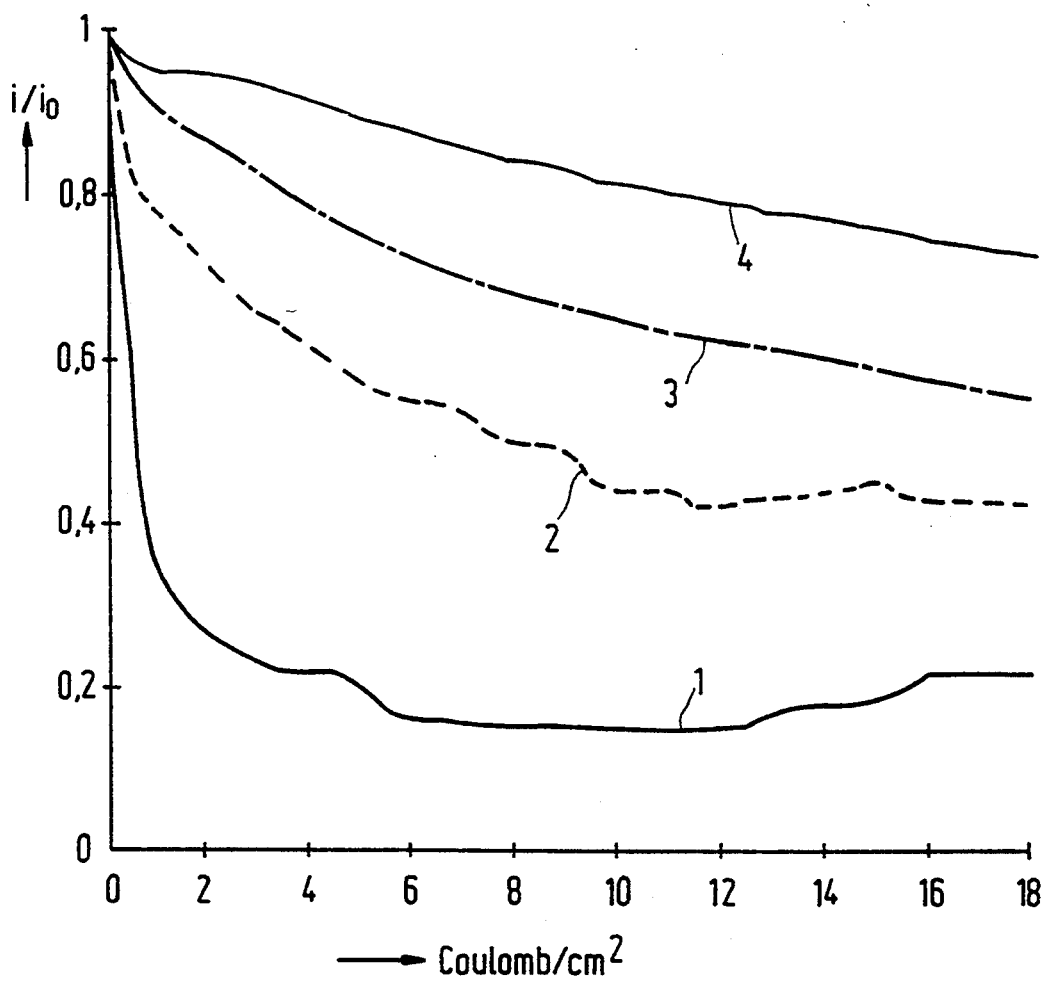
i/i0
1
0,8
0,6
0,4
0,2
0
0
2
4
6
8
10
12
14
16
18
Coulomb/cm2
1
2
3
4

METHOD OF MANUFACTURING A DISPLAY TUBE

BACKGROUND OF THE INVENTION

The invention relates to a method of manufacturing a cathode ray display tube whose inner space has a phosphor coating which can be excited to luminescent emission, said inner space being evacuated by means of a vacuum pump and being subsequently sealed in a gastight manner.

Display tubes of this type are, for example field emission guns (see Information Display 5, 1989, pp. 17 et seq., or IEEE Trans. E.D. 36, 1989, pp. 225 etc.). Such tubes must also be subsequently evacuated (see Valvo Berichte, 1974, pp. 77, et seq.).

The emission may be stimulated in an arbitrary manner, particularly by means of electron beams. It is known (Philips Technical Review 1989, pp. 335 et seq.) that the luminance of the light decreases with time often referred to as aging or (degradation) at a given electron irradiation intensity, dependent on the quantity of charge of the electron bombardment.

OH groups deposited on phosphor crystals are primarily responsible for the degradation, particularly when silicate-containing binding materials are used in manufacturing the phosphor coating.

Hitherto it has been attempted to decrease the degradation by heating the phosphor coating to approximately 350° C. However, only limited success was obtained with this method.

For example, at relatively low electron energies up to 5 keV, as are usual in flat cathode ray tubes, the heat treatment of the phosphor coating in vacuo at 350° C. does not lead to an adequate decrease of the degradation, because the phosphor surface changes at this high temperature to such an extent that this leads to a greater sensitivity to electron bombardment. However, at lower temperatures of approximately 100° C., the removal of the OH groups from the phosphor surface is much less effective.

OBJECTS AND SUMMARY OF THE INVENTION

It is an object of the invention to implement the method described in the opening paragraph in such a way that the degradation resulting from aging phenomena is decreased.

This object is achieved in that before and/or during evacuation a hydrolysable gas is introduced into the inner space for a limited time interval, using a partial pressure which is essentially larger than the eventual final vacuum pressure of the cathode ray tube, in that the evacuation is subsequently performed without any further supply of gas until the final vacuum pressure is achieved, whereafter the cathode ray tube is sealed in a gastight manner.

A non-oxidizing gas is advantageous as the hydrolyzable gas because oxidation of the phosphor surface will adversely affect its luminescing effect. A very suitable gas for this purpose is $BCl_3$. However, numerous gases having an equivalent effect, particularly a halides such as, for example $GeCl_4$ are also suitable. Other equivalent gases are known to those skilled in the art.

The gas introduced in accordance with the inventive method, for example $BCl_3$, is hydrolyzed by a reaction with the OH ions of the OH groups on the phosphor crystals. In the case of $BCl_3$, HCl is split off and exhausted during evacuation. It has been found advantageous to use heating temperatures for the method according to the much lower than those used in the prior art. Preferably the evacuation is performed at temperatures between 50° C. and 250° C., particularly at approximately 100° C.

In the method according to the invention, a decrease of the degradation to an extent hitherto not achieved has been achieved.

To decrease the degradation, it is sufficient that the partial pressure p of the hydrolysable gas and the time t of maintaining this pressure are chosen to result in a surface collision rate of the molecules of the hydrolysable gas having at least the rate obtained when using $BCl_3$ and a product $p.t=0.8.10^{-3}$ mbar. min. Higher values of the surface collision rate do not essentially enhance the degradation behaviour.

The invention is particularly suitable for field emission tubes because their phosphor coating lacks the aluminum over coating usually present on other cathode ray display tubes, so that the phosphor coating has an eminent contact with the hydrolysable gas. However, the invention is also suitable for other types of display tubes in so far as their phosphor coatings can be contacted with the hydrolysable gas.

These and other aspects of the invention will be apparent from and elucidated with reference to the embodiments described hereinafter.

BRIEF DESCRIPTION OF THE DRAWING

In the drawing the Figure shows degradation characteristic curves for ZnS:Ag phosphor, resulting from different methods of treatment.

The curves are plots of the relative intensity $i/i_o$ of the luminescent radiation measured at 4 keV electron energy versus the charge quantity provided in Coulombs per $cm^2$ of the phosphor surface.

Characteristic curve 1 was obtained after no special measures for enhancing the degradation behaviour had been taken, thus after an evacuation in the ambient temperature range and without introduction of a hydrolysable gas.

Characteristic curve 2 was obtained after the evacuation had been performed at 350° C. and without supply of a hydrolysable gas.

Characteristic curve 3 was obtained after the evacuation had been performed at 100° C. for 20 minutes and without the supply of a hydrolyzable gas.

It was surprisingly found that at 100° C. (70 min) and without supply of a hydrolysable gas the values obtained in accordance with characteristic curve 3 were even better than those in accordance with characteristic curve 2.

The most advantageous characteristic curve 4 was obtained by using the method according to the invention. During evacuation a $BCl_3$ partial pressure of $10^{-4}$ mbar at a temperature of 100° C. was maintained for 10 minutes.

It is important that no water vapour-containing gases such as atmospheric air can reach the phosphor surface after the hydrolysable gas has been introduced, because otherwise the degradation behaviour considerably deteriorates again.

We claim:

1. A method of manufacturing a cathode ray tube whose inner space is provided with a phosphor coating which can be excited to luminescent emission, said method comprising evacuating said inner space and sealing said inner space in a gastight manner, the improvement comprising introducing at least one hydrolyzable gas into said inner space before and/or during evacuation for a limited time while using a partial pressure that is larger than the eventual final vacuum pressure of the cathode ray tube and subsequently completing said evacuation while introducing no further hydrolyzable gas into said inner space and then sealing said ray tube in a gastight manner.

2. A method as claimed in claim 1, characterized in that the at said at least one hydrolyzable gas is a non-oxidizing gas.

3. A method as claimed in claim 2, characterized in that the at said at least one hydrolyzable gas is $BCl_3$.

4. A method as claimed in claim 2, characterized in that the partial pressure (p) of the hydrolyzable gas and the time of (t) of maintaining said pressure are chosen to result in a surface collision rater of the molecule of the at least one hydrolyzable gas with a surface of the inner space of at least the rate obtained when the at least one hydrolyzable gas is $BCl_3$ and the product $p.t=0.8\times10^{-3}$ mbar.min.

5. A method as claimed in claim 2, characterized in that the evacuation is performed at a temperature within the range of about 50° C. to 250° C.

6. A method as claimed in claim 5, characterized in that the evacuation is performed at a temperature of approximately 100° C.

7. A method as claimed in claim 1, characterized in that the at said at least one hydrolyzable gas is $BCl_3$.

8. A method of claimed in claim 7, characterized in that the partial pressure (p) of the at least one hydrolyzable gas and the time (t) of the maintaining said pressure are so chosen that the product p.t is at least $0.8\times10^{-3}$ m.bar.

9. A method as claimed in claim 7, characterized in that the evacuation is performed at a temperature within the range of about 50° C. to 250° C.

10. A method as claimed in claim 9, characterized in that the evacuation is performed at a temperature of approximately 100° C.

11. A method as claimed in claim 1, characterized in that the evacuation is performed at a temperature within the range of about 50° C. to 250° C.

12. A method as claimed in claim 11, characterized in that the evacuation is performed at a temperature of approximately 100° C.

13. A method as claimed in claim 11, characterized in that the partial pressure (p) of the at least one hydrolyzable gas and the time of (t) of maintaining said pressure are chosen to result in a surface collision rate of the molecule of the at least one hydrolyzable gas with a surface of the inner space of at least the rate obtained when the at least one hydrolyzable gas is $BCl_3$ and the product $p.t=0.8\times10^{-3}$ mbar.min.

14. A method claimed in claim 1 characterized in that the partial pressure (p) of the at least one hydrolyzable gas and the time (t) of maintaining said pressure are chosen to result in a surface collision rate of the molecules of the at least one hydrolyzable gas with a surface of the inner space of at least the rate obtained when the at least one hydrolyzable gas is $BCl_3$ and the product $p.t=0.8\times10^{-3}$ mbar.min.

* * * * *